US010330061B2

(12) United States Patent
Nong

(10) Patent No.: US 10,330,061 B2
(45) Date of Patent: Jun. 25, 2019

(54) FUEL INJECTION SYSTEM

(71) Applicant: PICOSPRAY, INC., Ann Arbor, MI (US)

(72) Inventor: Lihang Nong, Ann Arbor, MI (US)

(73) Assignee: PICOSPRAY, LLC., Ann Arbor, MI (US)

( * ) Notice: Subject to any disclaimer, the term of this patent is extended or adjusted under 35 U.S.C. 154(b) by 0 days.

(21) Appl. No.: 15/356,259

(22) Filed: Nov. 18, 2016

(65) Prior Publication Data

US 2017/0067429 A1 Mar. 9, 2017

Related U.S. Application Data

(63) Continuation of application No. 14/062,794, filed on Oct. 24, 2013, now Pat. No. 9,500,170.

(Continued)

(51) Int. Cl.

*F02M 51/06* (2006.01)
*F02M 61/18* (2006.01)

(Continued)

(52) U.S. Cl.

CPC ..... *F02M 51/0614* (2013.01); *F02D 41/20* (2013.01); *F02D 41/30* (2013.01); *F02M 51/04* (2013.01); *F02M 51/061* (2013.01); *F02M 57/021* (2013.01); *F02M 57/027* (2013.01); *F02M 59/025* (2013.01); *F02M 59/10* (2013.01); *F02M 61/02* (2013.01); *F02M 61/162* (2013.01); *F02M 61/186* (2013.01);

(Continued)

(58) Field of Classification Search

CPC .. F02M 51/04; F02M 51/061; F02M 51/0614; F02M 57/021; F02M 57/026; F02M 59/025; F02M 59/10; F02M 61/18; F02M 61/1853; F02M 61/186; F02M 61/162; F02M 61/20; F02M 2051/08; F02D 41/20; F02D 41/30; F02D 2041/2055; F02D 2041/2058

See application file for complete search history.

(56) References Cited

U.S. PATENT DOCUMENTS 4,116,591 A 9/1978 Mardell
4,121,125 A 10/1978 Dolz (Continued)

FOREIGN PATENT DOCUMENTS

EP 0 752 148 1/1997
EP 1 248 494 10/2002

(Continued)

OTHER PUBLICATIONS

Australia First Examination Report regarding Application No. 201334273 (6 pages).

(Continued)

*Primary Examiner* — Christopher S Kim
(74) *Attorney, Agent, or Firm* — Foley & Lardner LLP

(57) ABSTRACT

A fuel injector is provided. The fuel injector includes a sleeve having a first end proximate an outlet; a piston slidingly received in the sleeve, the piston having a first end proximate the outlet; a pumping chamber at least partially defined by the sleeve between the first end of the piston and the outlet; and a normally-open inlet valve through which fuel passes to enter the pumping chamber.

18 Claims, 8 Drawing Sheets

Related U.S. Application Data

(60) Provisional application No. 61/718,524, filed on Oct. 25, 2012.

(51) Int. Cl.

| | |
|---|---|
| ***F02M 51/04*** | (2006.01) |
| ***F02M 57/02*** | (2006.01) |
| ***F02M 61/02*** | (2006.01) |
| ***F02D 41/20*** | (2006.01) |
| ***F02D 41/30*** | (2006.01) |
| ***F02M 59/02*** | (2006.01) |
| ***F02M 59/10*** | (2006.01) |
| ***F02M 61/16*** | (2006.01) |
| ***F02M 61/20*** | (2006.01) |
| *F02M 51/08* | (2006.01) |

(52) U.S. Cl.
CPC ..... *F02M 61/20* (2013.01); *F02D 2041/2055* (2013.01); *F02D 2041/2058* (2013.01); *F02M 51/08* (2019.02); *F02M 2051/08* (2013.01)

(56) References Cited

U.S. PATENT DOCUMENTS

| | | | | |
|---|---|---|---|---|
| 4,327,695 | A | 5/1982 | Schechter | |
| 4,463,900 | A | 8/1984 | Wich | |
| 4,505,243 | A | 3/1985 | Miwa | |
| 4,915,602 | A | 4/1990 | Tschopp | |
| 5,107,890 | A | 4/1992 | Gute | |
| 5,351,893 | A | 10/1994 | Young | |
| 5,390,257 | A | 2/1995 | Oslac et al. | |
| 5,419,492 | A | 5/1995 | Gant et al. | |
| 5,469,828 | A | 11/1995 | Heimberg et al. | |
| 5,472,323 | A | 12/1995 | Hirabayashi et al. | |
| 5,511,955 | A | 4/1996 | Brown et al. | |
| 5,630,401 | A | 5/1997 | Binversie et al. | |
| 5,704,771 | A | 1/1998 | Fujisawa et al. | |
| 5,781,363 | A | 7/1998 | Rowan et al. | |
| 5,898,786 | A | 4/1999 | Geisenberger | |
| 6,081,112 | A | 6/2000 | Carobolante et al. | |
| 6,135,357 | A | 10/2000 | Herrin et al. | |
| 6,290,308 | B1 | 9/2001 | Zitzelsberger | |
| 6,373,957 | B1 | 4/2002 | Stewart | |
| 6,378,792 | B2 * | 4/2002 | Fukaya | F02M 61/168 239/533.12 |
| 6,394,367 | B2 | 5/2002 | Munezane et al. | |
| 6,422,836 | B1 | 7/2002 | Krueger et al. | |
| 6,614,617 | B1 | 9/2003 | Galloway | |
| 6,685,114 | B2 * | 2/2004 | Okamoto | F02M 51/0675 239/585.1 |
| 6,796,290 | B2 | 9/2004 | Boehland et al. | |
| 6,877,679 | B2 | 4/2005 | Lawes | |
| 6,923,163 | B2 | 8/2005 | Yamazaki | |
| 6,964,263 | B2 | 11/2005 | Xi et al. | |
| 6,966,760 | B1 | 11/2005 | Radue | |
| 7,063,520 | B2 | 6/2006 | Oh et al. | |
| 7,100,578 | B2 | 9/2006 | Yamazaki et al. | |
| 7,225,790 | B2 * | 6/2007 | Bartunek | F02M 51/0603 123/294 |
| 7,267,533 | B1 | 9/2007 | Tocci et al. | |
| 7,287,966 | B2 | 10/2007 | French et al. | |
| 7,309,025 | B2 | 12/2007 | Yamazaki et al. | |
| 7,377,266 | B2 | 5/2008 | Xi et al. | |
| 7,410,347 | B2 | 8/2008 | Radue | |
| 7,438,050 | B2 | 10/2008 | Allen | |
| 7,484,673 | B2 * | 2/2009 | Boecking | F02M 45/04 239/102.2 |
| 7,533,655 | B2 | 5/2009 | Allen | |
| 7,753,657 | B2 | 7/2010 | Strauss et al. | |
| 7,798,130 | B2 | 9/2010 | Allen | |
| 7,866,144 | B2 | 1/2011 | Bakaj et al. | |
| 8,079,825 | B2 | 12/2011 | Bocchiola | |
| 2003/0155444 | A1 | 8/2003 | Lawes | |
| 2005/0263135 | A1 | 12/2005 | Magel et al. | |
| 2006/0011735 | A1 * | 1/2006 | Magel | F02M 57/025 239/96 |
| 2006/0097067 | A1 | 5/2006 | Buehler et al. | |
| 2007/0095934 | A1 | 5/2007 | Wisdom | |
| 2009/0108093 | A1 | 4/2009 | Mattes et al. | |
| 2010/0011578 | A1 | 1/2010 | Beck et al. | |
| 2010/0193611 | A1 | 8/2010 | Burger et al. | |
| 2010/0236526 | A1 | 9/2010 | Wang et al. | |
| 2010/0312453 | A1 | 12/2010 | Smither | |

FOREIGN PATENT DOCUMENTS

| | | |
|---|---|---|
| EP | 1 367 225 | 12/2003 |
| EP | 2 198 140 | 6/2010 |
| GB | 2 452 955 | 3/2009 |

OTHER PUBLICATIONS

Corrected International Search Report and Written Opinion for Application No. PCT/US2013/066703, dated Jul. 28, 2014, 13 pages.
EP Extended Search Report dated May 17, 2016 regarding EP Application No. 13849666.6 (6 pgs.).
International Preliminary Report on Patentability completed Nov. 24, 2014 regarding Application No. PCT/US13/66703; 6 pgs.
International Search Report and Written Opinion dated Feb. 10, 2014 in relate PCT Application No. PCT/US2013/066703.
Chinese Office Action issued in corresponding application No. 201380055696.1 dated Dec. 5, 2016 with English translation.

* cited by examiner

FUEL INJECTION SYSTEM

CROSS-REFERENCE TO RELATED PATENT APPLICATIONS

This application is a Continuation of U.S. patent application Ser. No. 14/062,794, filed Oct. 24, 2013 (now U.S. Pat. No. 9,500,170), which claims the benefit of and priority to U.S. Provisional Patent Application No. 61/718,524, filed Oct. 25, 2012, the disclosures of the foregoing U.S. applications are hereby incorporated by reference in their entirety.

BACKGROUND

The present application relates generally to the field of internal combustion engines. More particularly, the present application relates to fuel injection systems for internal combustion engines.

Fuel injection systems provide fuel to an internal combustion engine. A typical fuel injection system includes a pump and an injector. The pump provides pressurized fuel from a tank to the injector, and the injector meters the fuel into the air intake or combustion chamber. A typical fuel injector uses a solenoid or piezoelectric system to move a needle, thereby permitting or preventing flow of the pressurized fuel through the fuel injector to an outlet nozzle. Internal combustion engines using fuel injection systems typically have cleaner emissions than carbureted; however, in many small engines, and in many parts of the world, carburetors are still widely used due to the cost and complexity of fuel injection systems. Thus, there is a need for an improved fuel injection system. There is a further need for an improved low-cost fuel injection system.

SUMMARY

One embodiment relates to a fuel injector including a sleeve having a first end proximate an outlet; a piston received in the sleeve and slidable between a first position and a second position, the piston having a first end proximate the outlet; a pumping chamber at least partially defined by the sleeve between the first end of the piston and the outlet; and a normally-open inlet valve through which fuel passes to enter the pumping chamber. The inlet valve may close when the piston has sufficient velocity to create sufficient pressure inside the fluid pumping chamber to close the inlet valve. The inlet valve may further include a valve body biased away from a valve seat by a valve spring, and wherein the inlet valve closes when the piston has sufficient velocity to create sufficient pressure inside the fluid pumping chamber to overcome the force of the inlet valve spring. The fuel injector may include a normally-closed outlet valve coupled to the first end of the sleeve. The inlet valve may be located in the piston. The piston may include a wall coupled to the inlet valve, the wall and the inlet valve at least partially defining a cavity in the piston, wherein fuel passes through the cavity to enter the pumping chamber. The fuel injector may include a magnetic actuation assembly supported by the housing and coupled to the piston, the magnetic actuation assembly configured to translate the piston. The magnetic actuation assembly may include a magnet and a coil.

Another embodiment relates to a fuel injector including a sleeve having a first end and a second distal the first end; a normally-closed outlet valve coupled to the first end of the sleeve; a piston received in the sleeve and slidable between a first position and a second position, the piston having a first end proximate the outlet valve and a second end distal the first end; a normally-open inlet valve through which fuel passes to enter the pumping chamber, the inlet valve coupled to the first end of the piston; and a pumping chamber at least partially defined by the sleeve between the inlet valve and the outlet valve. Movement of the piston from the second position to the first position forces fluid from the pumping chamber through the outlet valve, and movement of the piston from the first position to the second position draws fluid into the pumping chamber through the inlet valve. Reciprocation of the piston between the first and second positions may cause the fuel injector to act as a positive displacement or impulse pressure pump.

Another embodiment relates to a control system for a fuel injector. The control system may include a circuit configured to measure the voltage across a coil in the fuel injector corresponding to the velocity of the coil through a magnetic field. The control system may include a circuit configured to measure the voltage across a current sense resistor. The control system may include processing electronics configured to control the velocity and/or position of a piston in the fuel injector, for example, in response to a voltage across the coil and/or a voltage across the current sense resistor. The control system may include processing electronics configured to self-calibrate the control system.

Another embodiment relates to a control system for a fuel injector. The control system includes a circuit configured to measure a current through a coil in the fuel injector. The control system further includes processing electronics configured to receive the measured current from the circuit and to determine at least one of a velocity and a position of the coil through a magnetic field by correlating the measured current to the velocity of the coil.

Another embodiment relates to an outlet valve assembly for a fuel injector. The outlet valve assembly includes an outlet valve having a valve seat, a valve body, and a spring biasing the valve body against the valve seat such that the outlet valve assembly is normally closed. The valve opens passively under pressure. The outlet valve assembly may include at least one plate located downstream of the valve seat, wherein the at least one plate comprises an orifice plate having at least one orifice configured to atomize a flow of fuel passing through the at least one orifice. The at least one plate may include a second plate adjacent an upstream side of the orifice plate and a first plate adjacent an upstream side of the second plate, wherein the first plate and the second plate cooperate to increase or cause turbulence in a flow of fuel passing through the first and second plates. The valve body may include a ball located on the downstream side of the valve seat.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, will become apparent in the detailed description set forth herein and taken in conjunction with the accompanying drawings.

DETAILED DESCRIPTION

Figure 1:
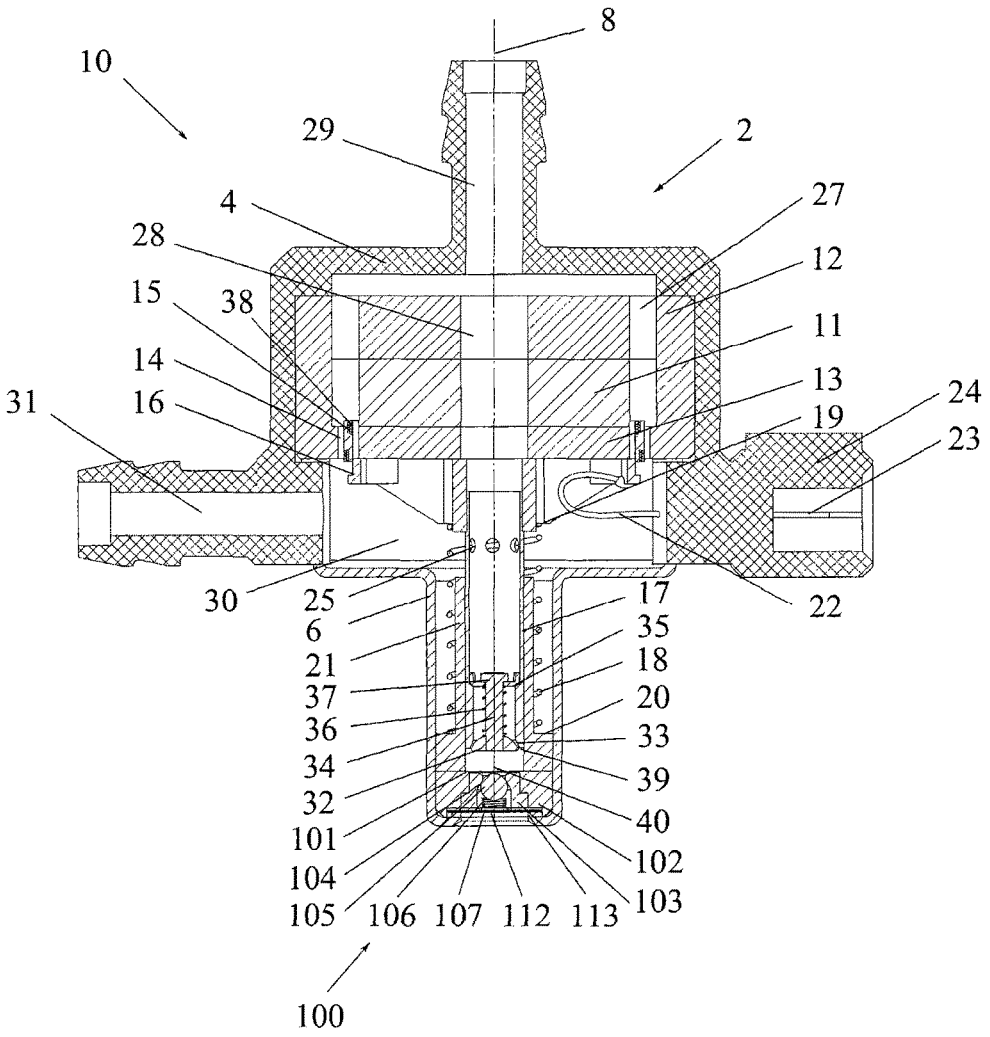
FIG. 1 is a sectional view of a fuel injector, shown in a first state, according to an exemplary embodiment.

Referring generally to the FIGURES, a fuel injection system, and components thereof, are shown according to an exemplary embodiment. The fuel injection system is shown to include a fuel injector and a control circuit. The injector includes a reciprocating piston, an inlet valve, an outlet valve, and a fluid pumping chamber. The injector further includes a coil actuator and a magnetic field, the interaction of which produces an electromagnetic force which drives the piston. Motion of the reciprocating piston in a direction that reduces the volume of the fluid pumping chamber forces fuel out of the injector. The inlet valve is normally open and closes when the piston moves with sufficient speed to generate sufficient pressure inside the fluid pumping chamber. Motion of the piston within the injector forces the fuel out through the orifice under pressure, thus negating the need for a separate fuel pump and pressure regulator, as required by conventional fuel injection systems, thus reducing the number of parts and components which are typically costly to produce. The injector may deliver fuel to the intake or directly into the combustion chamber of an internal combustion engine. While the fuel injection system is described with respect to fuel and internal combustion engines, the system may be used with other fluids in other applications. For example, the injector may be used to spray or inject other liquids, for example, water, beverage, paint, ink, dye, lubricant, scented oil, etc.

An exemplary circuit is provided for sensing and controlling the injector. Methods of sensing may use the circuit, or portions thereof, to directly determine the velocity of the piston and to indirectly determine the position of the piston. Methods of control may use the circuit, or portions thereof, to meter the amount of fuel injected for each pumping stroke of the piston. The sensing and controlling may be combined to form a closed-loop control system of the injector to precisely meter the amount of fuel being injected. In other embodiments, the injector may be operated in an open-loop system.

Before discussing further details of the fuel injection system and/or the components thereof, it should be noted that references to "top," "bottom," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIGS. 1-9, an injector 10 (e.g., sprayer, fuel injector, positive displacement pump, etc.) is shown, according to an exemplary embodiment. The injector 10 includes a housing 2, shown to include a first or upper portion, shown as end cap 4, and a second portion, shown as lower portion 6, coupled to the end cap 4. The end cap 4 is shown to include a fuel inlet 31, a vapor outlet 29, and an electrical plug or connector 24. One or more fuel filters (not shown) may be installed on the fuel inlet 31 and/or the vapor outlet 29. The end cap 4 defines a main cavity 30 and receives and supports a magnetic actuation assembly, which includes a magnet 11, a pole piece 12, a plate 13 (e.g., front plate, bottom plate, etc.), and a coil 15. The lower portion 6 defines a cavity configured to receive a piston 17 therein. The piston 17 is coupled to the magnetic actuation assembly by a cage 16, which transfers motion and forces therebetween. The magnet 11, pole piece 12, plate 13, coil 15, cage 16, former 38 and piston 17 are shown to be axially aligned along an axis 8 (e.g., longitudinal axis). According to various embodiments, the one or more of the components of the magnetic actuation assembly, the cage 16, the former 38, and the piston 17 are centered about the axis 8. While various components and elements are shown and described as being in either the end cap 4 or the lower portion 6, it is contemplated that, in various embodiments, a given component or element may be in either or both portions of the housing, or that the injector 10 may include a unitary housing.

The magnet 11 may be an axially magnetized permanent magnet coupled between (e.g., sandwiched between, interconnecting, etc.) the pole piece 12 and the plate 13, which are both made of a material with high magnetic permeability such as iron, low carbon steel, etc. According to other embodiments, other configurations found in "voice-coil" type actuators can be used to produce the same function, for example, a radially magnetized permanent magnet concentric with, and on the inside and/or outside of the coil 15. The pole piece 12 and the plate 13 define an annular gap 14 radially therebetween. The coil 15 is situated in the gap 14 with sufficient inward and outward radial clearance from the pole piece 12 and the plate 13, respectively to permit axial movement of the coil 15. The coil 15 is coupled to the cage 16 via the former 38, and the cage 16 is coupled to the piston 17. The coil 15 is wound from an electrically conductive material such as copper or aluminum with insulation. The cage 16 has at least one slot which allows fuel to pass therethrough and which minimizes the weight and drag of the cage 16.

According to the exemplary embodiment shown, magnetic actuation assembly comprises a moving coil type actuator (e.g., a "voice-coil" type actuator). The moving coil type actuator advantageously provides low inductance and hysteresis, which is well-suited for high frequency operation. Furthermore, the force acting on the coil 15 increases linearly with the current flowing therethrough and the force remains nearly constant throughout its entire stroke. These characteristics facilitate control of the actuator. Furthermore, the moving type actuator generates a large back EMF voltage proportional to its speed as it moves through the magnetic gap 14 between the pole piece 12 and plate 13. This back EMF voltage can be exploited to sense the velocity and derive the position of the coil 15. As described in an exemplary embodiment below, this information can be used in a closed-loop feedback control scheme to precisely meter the amount of fluid being injected or sprayed even in the presence of disturbances such as the presence of vapor bubbles and variations in supply voltage. According to other embodiments, a solenoid type actuator may be used. The position of the armature in a solenoid type actuator changes the solenoid coil's reactance, which affects the current through the solenoid coil and can be used to detect the velocity and position of the armature or plunger.

According to the embodiment shown, the piston 17 includes a substantially cylindrical wall having a first or top end, proximate the plate 13, and a second or bottom end, distal the plate 13. The piston wall defines a longitudinal piston cavity through which fluid passes during the piston pumping cycle, i.e., the injection cycle. The bottom end of the piston 17 is shown to include a piston end face 39 and an inlet valve seat 33 formed in the bottom end of the piston 17. The piston 17 is received in sleeve 21, which in turn is received in the lower portion 6 of the housing 2. The sleeve 21 is configured to permit axial translation or sliding of the piston 17 therein. The sleeve 21 may be a formed as a part of the housing 2 (e.g., as a bore formed or machined therein), or the sleeve 21 may be formed separately from the housing 2 and subsequently coupled thereto. The sleeve 21 further includes a ledge or step 20, and the cage 16 also includes a ledge or step 19. A main spring 18 is located between the step 19 on the cage 16 and the step 20 on the sleeve 21, and biases the cage 16 towards the plate 13. According to another embodiment, the main spring 18 can bias the cage 16 towards the outlet valve retainer 102. The upstroke or suction stroke of the piston 17 is initiated completely by the force of the coil 15; whereas, the down stroke of the piston 17 can be powered by the main spring 18 alone or with the help of the coil force in the reverse direction. This embodiment may allow a more precise control of the stroke of the piston 17.

Fresh fuel enters into the main cavity 30 (e.g., fuel chamber) via the fuel inlet 31. According to one embodiment, liquid fuel enters the piston cavity from the main cavity 30 via one or more holes 25 through the wall of the piston 17. According to another embodiment, the liquid fuel may pass through the cage 16 and enter the piston cavity through the top end of the piston 17 as piston 17 moves away from the plate 13 (see e.g., FIGS. 2 and 3).

The fuel inlet 31 is located relatively low on the injector 10 relative to the main cavity 30 and the vapor outlet 29. Any vapor in the injector 10 rises to the top of the injector 10 and out of the vapor outlet 29 due to buoyancy. Fuel vapor present in the injector 10 may come from the fuel supply (e.g., through fuel inlet 31) and/or may be generated inside the injector 10 due to a reduction in pressure and/or an increase in temperature. As shown, the fuel inlet 31 is substantially horizontal; however, the fuel inlet 31 may extend at downward angle from the end cap 4 to inhibit fuel vapor from travelling upstream through the fuel inlet 31. A series of holes, opening, orifices, etc., may form a low resistance path or passageway extending through the pole piece 12, the magnet 11, and the plate 13, to allow fuel vapor present in the fuel injector to escape through the vapor outlet 29 as part of the end cap 4. For example, according to one embodiment, the holes may be centrally aligned along longitudinal axis 8, shown as passageway 28. According to another embodiment, the holes may be offset from the axis 8, shown as passageway 27. According to another embodiment, the vapor passageway may include spacing between the pole piece 12 and the housing 2. Such venting of the fuel vapors helps provide reliable operation of the fuel injector during hot operating conditions.

Figure 4:
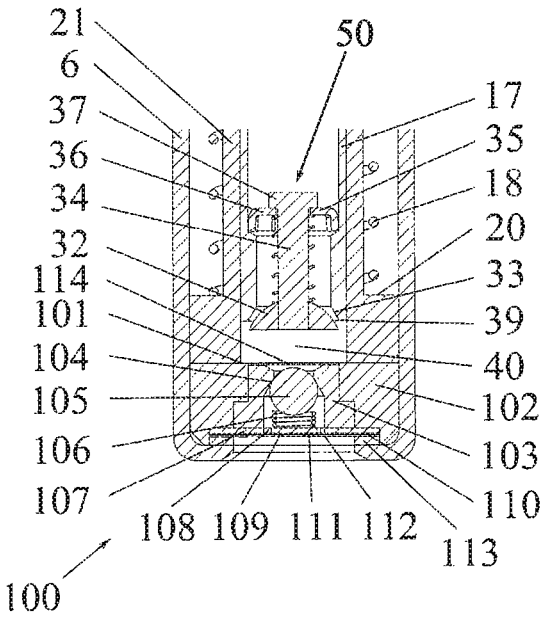
FIG. 4 is a sectional view of a portion of the fuel injector of FIG. 1, shown in a first state, according to an exemplary embodiment.

Referring specifically to FIG. 4, an inlet valve 50 is located at the bottom end of the piston 17, according to an exemplary embodiment. The inlet valve 50 includes an inlet valve body 32 coupled to an inlet valve stem 34, an inlet valve retainer 35, and an inlet valve spring 36. The inlet valve body 32 seals against the inlet valve seat 33 at the bottom end of the piston 17. The inlet valve body 32 is shown to have a semi-spherical shape while the inlet valve seat 33 is shown to have a conical shape to provide self-alignment of the inlet valve body 32 to the inlet valve seat 33, which improves sealing therebetween. The rounded lip on the inlet valve body 32 reduces the pressure drop of the fuel flowing into the fluid pumping chamber 40. According to the embodiment shown, the inlet valve body 32 is coupled to the inlet valve stem 34 via an interference fit. The inlet valve stem 34 is received by and axially translates (e.g., slides) within an aperture (e.g., opening, hole, central hole, etc.) through the inlet valve retainer 35. The inlet valve retainer 35 is shown to include at least one slot which allows fuel to pass therethrough and is coupled to the piston 17, for example, via an interference fit or an adhesive. As shown, the inlet valve retainer 35 is in a cup shape which can be formed out of a thin sheet by relatively inexpensive methods (e.g., stamping, etc.) and can provide interference fit with the piston without excessive force which can cause deformation thereof. According to another embodiment, the inlet valve body 32 may be unitarily or integrally formed with the inlet valve stem 34, which in turn is coupled to a flange 37 (e.g., projection, stub, etc.) via an interference fit.

According to the exemplary embodiment shown, the inlet valve body 32 is biased away from the inlet valve seat 33 by the inlet valve spring 36 so that it is normally open, i.e., normally allows fuel to enter into the fluid pumping chamber 40 from inside the piston cavity. The flange 37 on an end of the inlet valve stem 34 distal the inlet valve body 32 limits the travel of the inlet valve body 32 in the open position. The fluid pumping chamber 40 is substantially defined on top by the piston end face 39 and inlet valve body 32, on the bottom by the top face 101 of an outlet valve retainer 102 and an outlet valve seat body 103, and on the sides by the inside wall of the sleeve 21.

The normally open inlet valve 50 allows fuel to enter the fluid pumping chamber 40 by gravity alone, which reduces the priming requirements particularly when the fluid pumping chamber 40 is full of fuel vapor or when there is no fuel in the injector 10 at all. The normally open inlet valve 50 combined with its large flow area also reduces the pressure drop during the upstroke of the piston 17, which reduces the formation of fuel vapors. Furthermore, having the inlet valve 50 open at the start of an injection cycle allows the piston 17 to gain velocity without significant resistance. Once the inlet valve 50 closes, the piston 17 will have gained enough velocity to generate a high pressure inside the fluid pumping chamber 40, which increases the amount of fuel atomization through the orifice plate 112 of the outlet. Further, the increased velocity of the piston 17 may create sufficient pressure in the fluid pumping chamber 40 to collapse or condense fuel vapor bubbles therein. Upon closing of the inlet valve 50, the pressure in the fluid pumping chamber 40 increases substantially. This large pressure rapidly decelerates the piston 17, partially also due to the low mass of the moving components. This substantial reduction in velocity can be observed by monitoring the voltage across the coil 15 and/or across a current sense resistor to mark the beginning of an injection event. According to another embodiment, the inlet valve 50 can be located elsewhere other than on the piston 17 such as on the sleeve 21, while still in fluid communication with the fluid pumping chamber 40. According to another embodiment, the inlet valve 50 may also be used with another check valve such that one valve is responsible for introducing fluid into the fluid pumping chamber 40, while the other valve is used to expel vapor.

Another advantage of the normally open inlet valve 50 is that it allows fuel vapor in the fluid pumping chamber 40 to pass through the inlet valve 50 due to the orientation of the injector 10 and the buoyancy of the fuel vapor relative to the liquid fuel. The presence of fuel vapor bubbles in the fluid pumping chamber 40 could potentially cause a positive displacement type pump to meter the incorrect amount of fuel. This is due to the fact that the presence of bubbles will change the bulk density of the fuel being metered so that the same volume of fuel being injected will not correspond to the same mass. The chances of fuel vapor bubbles being generated or brought into the fluid pumping chamber is high in particular when the fuel injector is hot and during the upstroke of the piston 17 in which the flow of fuel past the restriction of the inlet valve 50 causes the fuel to decrease in pressure. According to embodiments described in more detail below, the injector 10 provides an initial low pressure portion of the stroke in which the inlet valve 50 does not close and any vapor bubbles present in the fluid pumping chamber 40 exits through the inlet valve 50 and/or may be condensed into liquid form.

Figure 3:
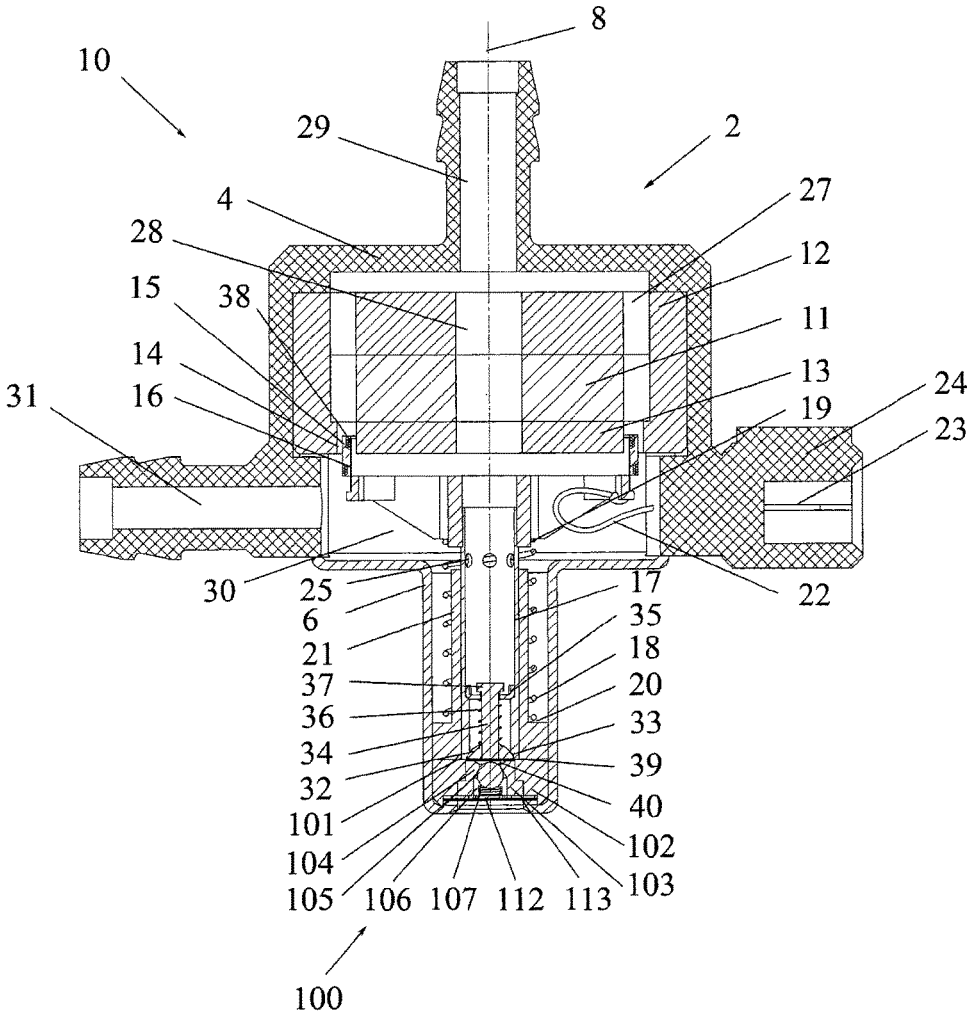
FIG. 3 is a sectional view of the fuel injector of FIG. 1, shown in a third state, according to an exemplary embodiment.

Referring to FIG. 3, the piston 17 is limited in travel in the downward direction by the outlet valve retainer 102. According to one embodiment, the end face 39 contacts (e.g., touches, impacts, kisses, etc.) a top face 101 of the outlet valve retainer 102. The end face 39 contacting the top face 101 may include embodiments in which the end face 39 is spaced apart from top face 101 by a minimal amount of residual fluid. The residual fluid may act as shock absorber between the end face 39 and the top face 101. According to an exemplary embodiment, the fluid in the fluid pumping chamber 40 reduces or limits the speed of the piston 17 as it approaches the outlet valve retainer 102, thereby absorbing some of the shock of contact as the last remnants of fluid are pushed out of the fluid pumping chamber 40. According to another embodiment, a disk spring may be placed on top of the outlet valve retainer 102 to reduce the impact force of the piston 17. According to other embodiments, the piston 17 does not contact the outlet valve retainer 102. However, during the high pressure portion of the stroke, the fuel inside the fluid pumping chamber 40 has an elevated temperature due to the increase in pressure. After the high pressure portion of the stroke, the hot fuel inside the high compression chamber can flash (e.g., evaporate, boil, etc.) into vapor because its pressure falls to near atmospheric levels. The small volume between the piston 17 and the outlet valve retainer 102 when the piston 17 is at the bottom position (i.e., at the bottom end of the stroke) limits the amount of vapor that is generated. That is, reducing the amount of fuel remaining in the fluid pumping chamber 40 may reduce the amount of fuel vapor generated during the upstroke of the piston 17. Further, as shown and described, the inlet and outlet valve configurations provide the injector 10 with a large compression ratio (the ratio of the maximum volume of the fluid pumping chamber 40 when the piston 17 is at its top position to the minimum volume of the fluid pumping chamber 40 when the piston 17 is at its bottom position), which increases the self-priming ability of the injector 10.

Figure 5:
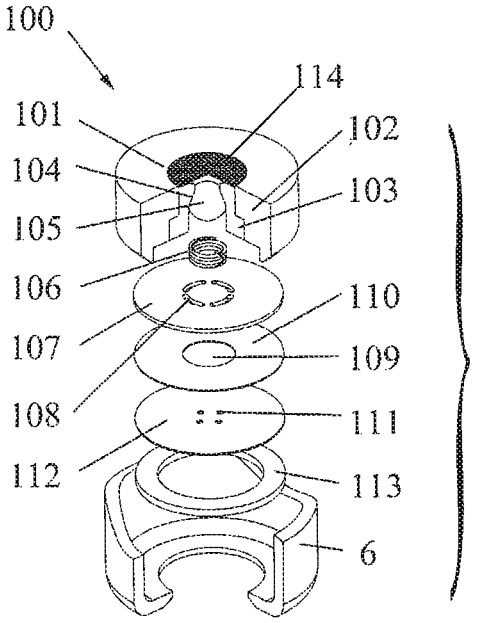
FIG. 5 is an exploded, perspective view of an outlet valve assembly of the fuel injector of FIG. 1.
Figure 6:
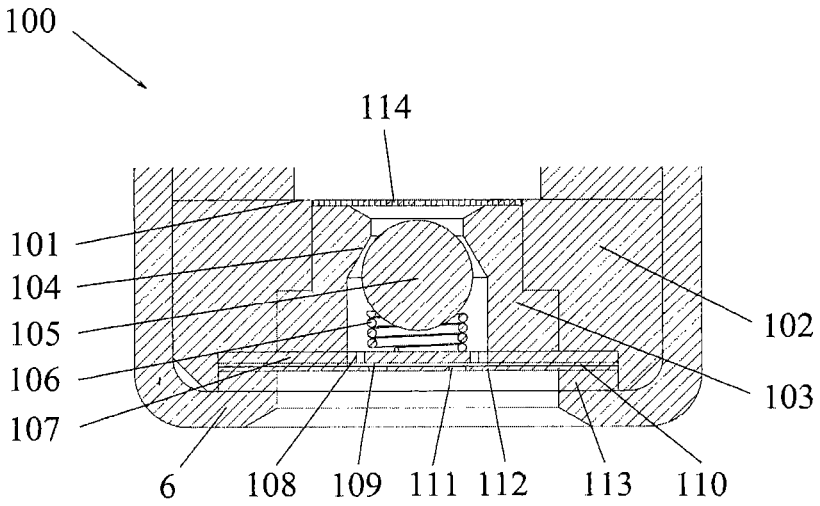
FIG. 6 is a sectional view of the outlet valve assembly of the fuel injector of FIG. 5.

Referring to FIGS. 5 and 6, an outlet valve assembly 100 is located in the bottom of the lower portion 6 of the housing 2, according to an exemplary embodiment. The outlet valve includes the outlet valve retainer 102, the outlet valve seat body 103, an outlet valve body 105 (e.g., ball, check, etc.), and an outlet valve spring 106. The outlet valve retainer 102 supports the outlet valve seat body 103 which has an outlet valve seat 104. The outlet valve body 105 is biased towards the outlet valve seat 104 by the outlet valve spring 106. According to the embodiment shown, the outlet valve body 105 is a polished sphere and the outlet valve seat 104 is a polished cone, thereby ensuring self-alignment and a good seal. The outlet valve spring 106 is sandwiched between the outlet valve body 105 and a turbulence generating plate 107. The turbulence generating plate 107 has at least one slot 108, shown to extend in an at least partially circumferential arc. The one or more slots 108 allow fuel to pass therethrough to a turbulence gap 109 defined by an outlet washer 110 (e.g., disc, plate, etc.) and out of the fuel injector through one or more orifices 111 passing through an orifice plate 112. A sealing washer 113 (e.g., ring, disc, plate, etc.) seals the orifice plate 112 against the lower portion 6 of the housing 2. A filter 114 may be used to prevent debris from entering the outlet valve. The outlet valve assembly 100 as shown, in particular the arrangement of the turbulence generating plate 107, the outlet washer 110, and the orifice plate 112 is able to achieve a high turbulence in the fuel flow which increases the amount of fuel atomization. The above three components can be manufactured out of sheet metal by inexpensive methods.

Figure 7:
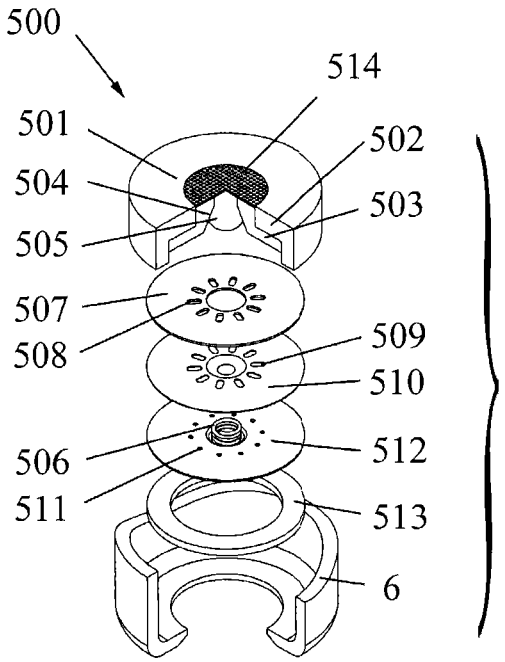
FIG. 7 is an exploded, perspective view of an outlet valve assembly of the fuel injector of FIG. 1, according to another embodiment.
Figure 8:
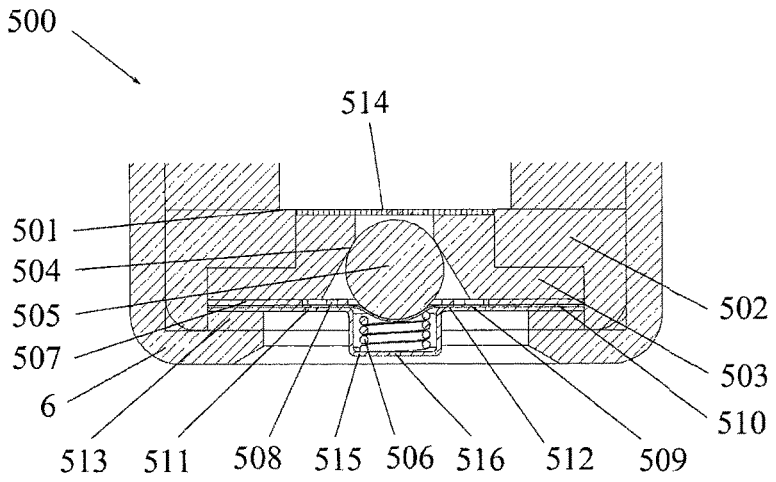
FIG. 8 is a sectional view of the outlet valve assembly of the fuel injector of FIG. 7.
Figure 9:
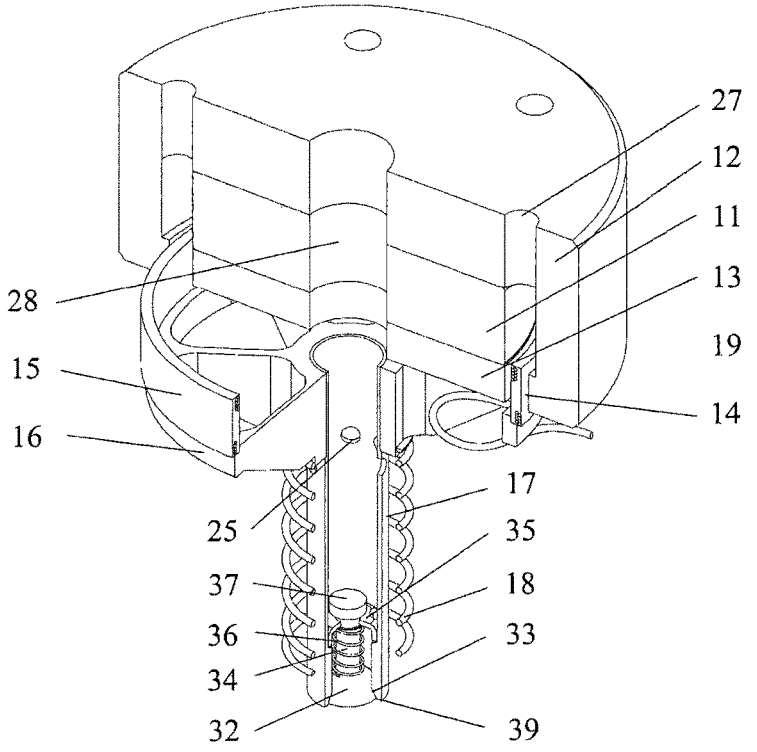
FIG. 9 is a perspective, cutaway view of the magnetic structure and moving components of the fuel injector of FIG. 1.

Referring to FIGS. 7 and 8, an outlet valve assembly 500 is shown according to another exemplary embodiment. The outlet valve assembly 500 is located in the bottom of the lower portion 6 of the housing 2. The volume of fuel between the outlet valve seat 104, 504 and the orifices 111, 511 is commonly referred to as the "sac". During hot operating conditions, this volume of fuel has a tendency to drip into the engine intake and/or engine cylinder, which may affect fuel metering and may deposit liquid fuel (e.g., non-atomized fuel) into the engine intake and/or engine cylinder. The embodiment of the outlet valve shown in FIGS. 7 and 8 reduces the "sac" volume, thereby reducing leakage of fuel into the engine intake and/or engine cylinder. The outlet valve includes an outlet valve retainer 502, an outlet valve seat body 503, an outlet valve body 505 (e.g., ball, check, etc.), and an outlet valve spring 506. The outlet valve retainer 502 supports the outlet valve seat body 503 which has an outlet valve seat 504. The outlet valve body 505 is biased towards the outlet valve seat 504 by the outlet valve spring 506. According to the embodiment shown, the outlet valve body 505 is a polished sphere and the outlet valve seat 504 is a polished cone, thereby ensuring self-alignment and a good seal. The turbulence generating plate 507 is located below the outlet valve seat body 503 and has at least one radially oriented slot 508. A sac sealing film 510, preferably made of an easily deformable, resilient material or a soft flexible material is located below the turbulence generating plate 507 and also has at least one radially oriented slot 509. As shown, the plurality of radially oriented slots 509 on the sac sealing film 510 overlap (i.e., align with) the plurality of radially oriented slots 508 on the turbulence generating plate 507. The sac sealing film 510 is also located between the outlet valve spring 506 and the outlet valve body 505. An orifice plate 512 is located below the sac sealing film 510 and has one or more orifices 511 aligned with the slots 508, 509 on the turbulence generating plate 507 and the sac sealing film 510. The center of the orifice plate 512 is a formed in the shape of a cup 515 to receive the outlet valve spring 506. The cavity of the cup 515 can be vented to the outside of the cup 515 by the opening 516 (e.g., orifice, hole, vent, etc., best seen in FIG. 8) and is sealed against the sac volume by the sac sealing film 510. According to another embodiment, the cup 515 that receives the outlet valve spring 506 may be part of a member that is separate from the orifice plate 512. A sealing washer 513 (e.g., ring, disc, plate, etc.) seals the orifice plate 512 against the lower portion 6 of the housing 2. A filter 514 may be used to prevent debris from entering the outlet valve.

According to other embodiments, outlet valve designs other than those described above and shown in FIGS. 5-8 may also be used with the injector 10. For example, the outlet valve body 105, 505 can have a variety of shapes, for example, flat plate, conical, poppet, mushroom, semi-spherical, etc. An outward opening pintle-type valve can also be used and can be advantageous because it does not have any sac volume since the sealing area also acts as the metering area. The orifices and structures for improving atomization other than the aforementioned designs may also be used with the fuel injector 10. For example, the orifices 111, 511 can be angled and/or tapered to affect the spray shape. Structures can be employed to introduce swirl to the fuel before reaching the orifices 111, 511. The outlet valve spring 506 can also be a resilient planar member, a spring washer, a solid flexible member, a conical helical spring, etc.

Figure 2:
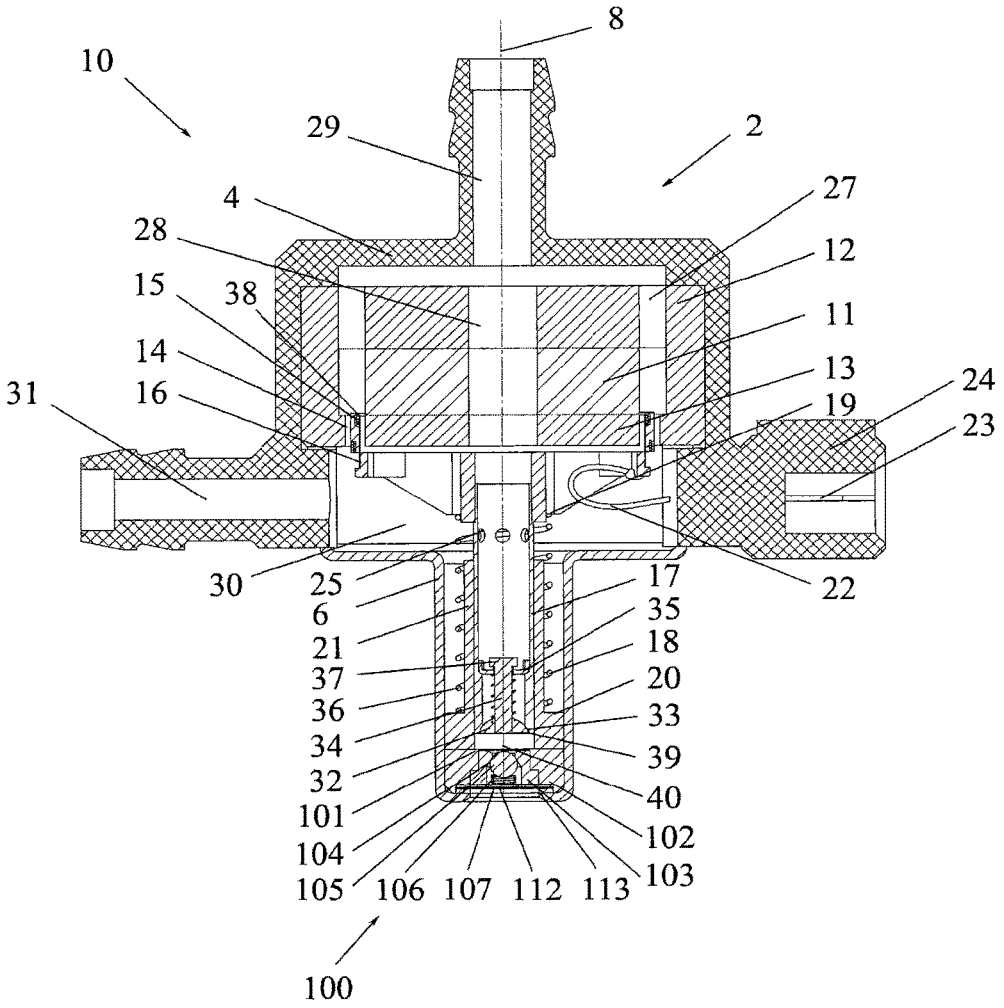
FIG. 2 is a sectional view of the fuel injector of FIG. 1, shown in a second state, according to an exemplary embodiment.

Referring to FIGS. 1-3, the connector 24 is shown to include a pin 23, which is electrically coupled to a first end of the coil 15 with an electrically conductive lead 22 (e.g., wire, conductor, etc.). A second pin or a second portion of the pin 23 may be coupled to a second end of the coil 15 by a second lead (not shown). The wire leads such as lead 22 are preferably flexible as to prevent fatigue failure and to not impede the motion of the piston 17 and other components that move with it. These "moving components" include the coil 15, the cage 16, the former 38, part of the lead 22, part of the main spring 18, the inlet valve retainer 35, and in some cases the inlet valve body 32 and inlet valve stem 34 by the contact of the inlet valve body 32 against the inlet valve seat 33 or by the transmission of sufficient force by the inlet valve spring 36.

The connector 24 may be configured as a male or female connector, and is connected to processing electronics (e.g., an electronic control unit (ECU), processing electronics, etc.), which is capable of causing sufficient current to pass through the coil to actuate the injector 10. The processing electronics may include a memory and processor. The processor may be or include one or more microprocessors, an application specific integrated circuit (ASIC), a circuit containing one or more processing components, a group of distributed processing components, circuitry for supporting a microprocessor, or other hardware configured for processing. According to an exemplary embodiment, the processor is configured to execute computer code stored in the memory to complete and facilitate the activities described herein. The memory can be any volatile or non-volatile memory device capable of storing data or computer code relating to the activities described herein. For example, the memory may include one or more modules which are computer code modules (e.g., executable code, object code, source code, script code, machine code, etc.) configured for execution by the processor. Exemplary modules may include a low pressure portion of the stroke module, a high pressure portion of the stroke module, an injector priming module, a self-calibration module, etc. When executed by the processor, the processing electronics is configured to complete the activities described herein. The processing electronics includes hardware circuitry for supporting the execution of the computer code of the modules. For example, the processing electronics may include hardware interfaces for communicating control signals (e.g., analog, digital) from the processing electronics to the injector 10 (e.g., pin(s) 23). The processing electronics may also include an input for receiving or sensing data or signals (e.g., feedback signals) from the injector 10 (e.g., pin(s) 23) and from various sensors indicating engine operating conditions (e.g., phase, crank angle, engine speed, engine temperature, coolant temperature, air temperature, etc.).

A piston pumping cycle is described, according to an exemplary embodiment. As shown in FIG. 1, at the start of an injection event, the cage 16 is biased by the main spring 18 to a first or top position against the plate 13. The processing electronics cause a sufficient current in the coil 15, which interacts with the magnetic field in the gap 14 generated by the configuration of the magnet 11, the pole piece 12, and plate 13 to produce a downward force on the coil 15 and a subsequent downward motion of the moving components. The start of an injection event begins with a driving current with a digital (e.g., pulse width modulation (PWM)) signal with less than 100% duty cycle or less than full supply analog level. This low duty cycle driving current does not allow the piston 17 to move fast enough to produce sufficient pressure inside the fluid pumping chamber 40 to overcome the force of the inlet valve spring 36 and thereby close the inlet valve. The initial low speed stroke is long enough so that any vapor present in the fluid pumping chamber 40 exits between the open inlet valve body 32 and inlet valve seat 33 due to the orientation of the injector 10, buoyancy of vapor bubbles, and a positive pressure gradient. After a certain length of initial stroke, the driving current increases sufficiently to produce sufficient velocity of the piston 17 to create sufficient pressure inside the fluid pumping chamber 40 to overcome the force of the inlet valve spring 36 and close the inlet valve. If the closing pressure of the inlet valve is sufficiently high, vapors present in the fluid pumping chamber 40 can also collapse or condense before the inlet valve closes.

The closing of the inlet valve marks the start of the second fluid pumping stroke, as shown in the position depicted by example in FIG. 2. Thereafter, the pressure inside the fluid pumping chamber 40 increases at a rapid rate, which causes the differential pressure across the outlet valve body 105 to overcome the force of the outlet valve spring 106 and open the outlet valve. The opening of the outlet valve allows fuel to flow through the slots 108 in the turbulence generating plate 107, through the turbulence gap 109 in the outlet washer 110, and out of the injector through the orifices 111 in the orifice plate 112. The end of the injection event occurs when the velocity of the piston 17 falls below a rate sufficient to generate a pressure inside the fluid pumping chamber 40 sufficient to keep the outlet valve in an open position, which can happen, for example, when the end face 39 of the piston 17 contacts the top face 101 of the outlet valve retainer 102, or when the current through the coil 15 is not large enough to sustain the sufficient velocity. At the end of an injection event, the processing electronics cause the current to the coil 15 to stop (e.g., cease), which allows the main spring 18 to move the moving components upward until the cage 16 rests against the plate 13 or until a sufficiently large current is again applied through the coil 15. According to one embodiment, the inlet valve opens during the upstroke of the piston 17, thereby allowing fuel to pass through the inlet valve from the piston cavity to fill the fluid pumping chamber 40. According to an embodiment in which the piston 17 does not contact the outlet valve, when the current to the coil 15 is stopped, the velocity of the piston 17 decreases such that the pressure inside the fluid pumping chamber 40 drops below the cracking pressure of the outlet valve.

Figure 10:
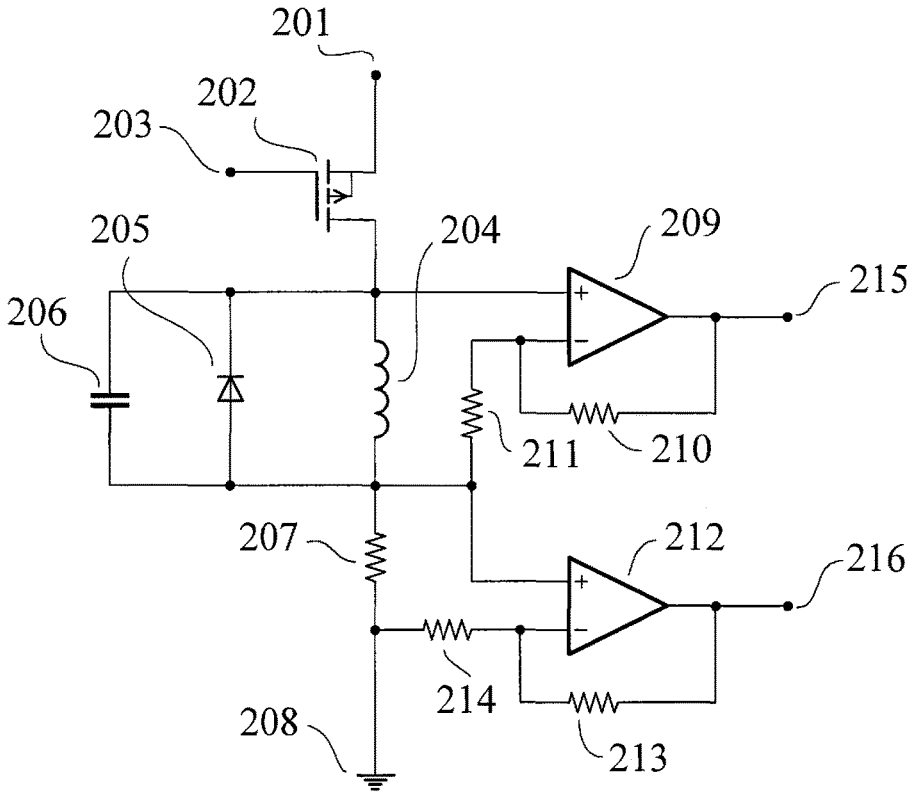
FIG. 10 is a schematic diagram of a circuit used to sense and control the fuel injector of FIG. 1, shown according to an exemplary embodiment.

Referring now to FIG. 10, a circuit used to control and sense the injector 10 is shown, according to an exemplary embodiment. A voltage supply is connected to node 201 which is connected to the source of a transistor 202. As shown, the transistor 202 is a P-channel MOSFET. The gate 203 of the transistor 202 may be controlled by the processing electronics or a portion thereof, for example, by a digital signal from a microprocessor, either directly or through one or more other amplifiers. The drain of the transistor 202 is connected one end (e.g., a first end) of the coil 204, while the other end (e.g., a second end) of the coil 204 is connected to one end (e.g., a first end) of the current sense resistor 207. This coil 204 refers to the same coil 15 in FIGS. 1-3 and 9, which has its own resistance and inductance. The other end (e.g., the second end) of the current sense resistor 207 is connected to a ground 208. A small capacitor 206 and a diode 205 with its cathode connected to the drain of the transistor 202 are shown connected in parallel with the coil 204. A first operational amplifier 209 measures the voltage across the coil 204 and outputs (e.g., provides a signal) to node 215. The values of the resistor 211 and resistor 210 set the gain of the operational amplifier 209. A second operational amplifier 212 measures the voltage across the current sense resistor 207 and outputs to node 216. The values of the resistor 214 and the resistor 213 set the gain of the operational amplifier 212.

Before the start of an injection cycle, the signal at the gate 203 of the transistor 202 is greater than the threshold which does not allow current to pass through from the source of the transistor 202 to its drain. At the start of an injection cycle, a low signal is sent to the gate 203 of the transistor 202 such that it is operating in saturation after a small amount of time, which allows current to flow from its source to its drain. The voltage at the top end of the coil 204 is now at the supply voltage of node 201 minus the voltage drop across the transistor 202, which causes current to travel through the coil 204 and the current sense resistor 207 to the ground 208. When it is desired to stop current through the coil 204, the signal at the gate 203 of the transistor 202 is raised to above the threshold which stops current flow from the source to the drain. Due to the inductance of the coil 204, its current does not stop immediately but flows through the diode 205 for a short time during which energy stored in the magnetic field of the coil 204 is dissipated through the resistance of the coil 204. An additional resistor can be added in series with the diode 205 to reduce the time to dissipate the energy through the coil 204. The diode 205 is known as a "freewheeling" diode, which protects the drain of the transistor 202 from large negative transient voltages due to the inductance of the coil 204. The capacitor 206 prevents a large spike in voltage because the diode 205 has a small but finite turn-on time. The first and second operational amplifiers 209 and 212 can be used to sense the voltages across the coil 204 and current sense resistor 207 at any time. The outputs nodes 215 and 216 can be output to (e.g., received by) processing electronics or a portion thereof, for closed-loop control of the coil 204.

The circuit mentioned above is only one method of driving and sensing the coil 204. There exists other methods that are capable of achieving the same, such as with the use of another type of transistor (e.g., a field effect transistor (e.g., an N-channel MOSFET, a JFET, etc.)), a bipolar junction transistor, etc., with appropriate modifications to the circuit. Alternatively, the voltage from the current sense resistor 207 can be used to provide a current controlled source using negative feedback.

Figure 11:
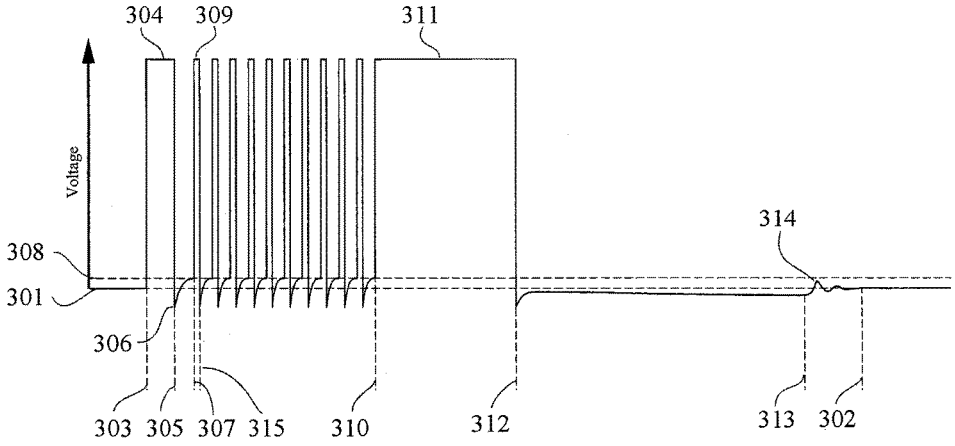
FIG. 11 is a graph of voltage across the coil of the fuel injector of FIG. 1, shown according to an exemplary embodiment.

Referring to FIG. 11, the voltage across the coil 15, 204 is measured by a first operational amplifier 209, shown, for example, in FIG. 10, during an injection event using a first method of control can be seen in waveform 301, according to an exemplary embodiment. At the start of an injection event at instance 303, a large pulse 304 is caused in the coil by the processing electronics. The large pulse is of sufficient width to bring the velocity of the coil 15 close to a target value. At instance 305, the processing electronics cause the voltage to cease across the coil 15, which causes a negative voltage spike 306 due to the inductance of the coil 15. Before instance 307, all existing energy stored in the magnetic field of the coil 15 has been dissipated and a back EMF voltage 308 is generated across the now "floating" coil corresponding to the velocity of the coil 15. The processing electronics may read (e.g., receive, receive a signal corresponding to, etc.) the voltage 308 and compares it with a target value. In response, the processing electronics may make changes to the pulse width of the control pulse 309 defined by the time between instance 307 and instance 315 to correct for any errors. For example, the processing electronics may add and control extra pause time after the instance 307 to correct for errors in the coil velocity. According to some embodiments, the analog level or duty cycle of the control pulse 309 can be controlled to correct for errors in the coil velocity as well. The velocity target value can be a fixed value or can vary. For example, the processing electronics may vary the velocity target value in response to sensor inputs, which can be indicative of engine operating conditions, for example, engine speed, temperature, and load. According to one embodiment, the velocity target value(s) may be stored in the memory of the processing electronics. During the pause time, the velocity of the coil 15 is reduced due to drag forces and the force from the main spring 18 but is still positive so that the coil 15 continues to move downwards. As shown in FIG. 11, there can be a large number of pause and control pulse cycles during this initial low pressure portion of the stroke. While the voltage 308 of the waveform 301 is shown to be constant, in practice, the level of the voltage 308 may increase or decrease for after each pulse due to the velocity of the coil 15.

At the instance 310, the high pressure pulse 311 begins. At some instance shortly after the instance 310, the velocity of the piston 17 reaches a sufficient speed in order to generate sufficient pressure inside the fluid pumping chamber 40 to cause the inlet valve to close and the outlet valve to subsequently open, which marks the beginning of the high pressure portion of the stroke. The arrangement of the mechanical components during the high pressure portion of the stroke can be seen, for example, in FIG. 2. At the instance 312, the current applied to the coil 15 is stopped, which allows the coil 15 and the moving components to begin traveling upward due to the biasing force of the main spring 18. At the instance 313, the cage 16 has come in contact with the plate 13 and is shown to experience some oscillations which can be seen in the back EMF oscillations 314. At the instance 302, the injector 10 has completed an injection event or cycle and is ready to for the next event or cycle.

Using the waveform in FIG. 11 or some variations thereof, the amount of fuel being injected per stroke can be controlled by varying the piston travel distance of the initial low pressure portion of the stroke. For example, the processing electronics may be configured to cause a long low pressure portion of the stroke, thereby allowing liquid and vapor fuel to pass out of the fluid pumping chamber 40 through the inlet valve before beginning the high pressure portion of the stroke, which reduces the remaining fuel in the fluid pumping chamber 40 available to be injected during that stroke. The processing electronics may cause a high duty cycle ejection pulse of sufficient width so that the end face 39 of the piston 17 contacts the top face 101 of the outlet valve retainer 102. The length of the initial low pressure portion of the stroke can be varied by changing the number of pause and control pulses, the target velocity at each pause pulse, or some combination thereof.

The system and method described with respect to the waveform of FIG. 11 is particularly advantageous for control because it allows several feedback loops to take place during a single injection event to precisely meter the amount of fuel being injected. Further, because the voltage 308 corresponds to the velocity of the coil 15, and thus the velocity of the piston 17, the processing electronics may determine a position or displacement (e.g., length of stroke thus far, distance traveled from the start of the cycle, etc.) of the piston 17 by integrating the voltages 308 or corresponding velocities. The processing electronics may then use the position or displacement information to control the amount of fuel injected per stroke. Another advantage of the system and method described with respect to the waveform of FIG. 11 is that fuel metering is based on positive displacement, which provides consistent metering independent from factors such as variations in the manifold pressure, variations in the orifice sizes due to manufacturing tolerances and/or formed deposits with use, variations in the friction and drag of the moving components, and variations in the force produced by the coil. A low pressure portion of the stroke module in the processing electronics may be configured to control the injector 10 as described above with respect to FIG. 11.

Figure 12:
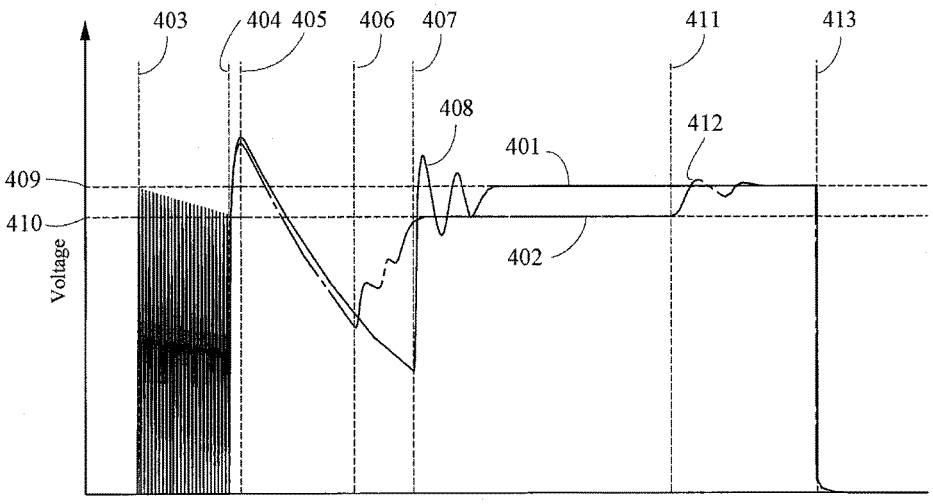
FIG. 12 is a graph of voltage across a current sense resistor of the circuit of FIG. 10, shown according to an exemplary embodiment.

Referring now to FIG. 12, the voltage across a current sense resistor 207, shown for example in FIG. 10, during an injection event using a second method of control can be seen in the waveform 401 and the waveform 402, according to exemplary embodiments. The voltage across the current sense resistor 207 is proportional to the amount of current flowing through the coil 15, 204 when the current flows from the drain of the transistor 202 to the ground 208, as shown in FIG. 10. Waveform 401 represents the voltage across the current sense resistor 207 in an injection event in which little or no liquid fuel is inside the fluid pumping chamber 40. Waveform 402 represents the voltage across the current sense resistor 207 in an injection event in which the fluid pumping chamber 40 is substantially filled with liquid fuel.

At the start of an injection event at the instance 403, the processing electronics cause a voltage to be applied across the coil 15, 204 with a low duty cycle until the instance 404. During this time, the piston 17 does not move with sufficient velocity to generate sufficient pressure in the fluid pumping chamber 40 to close the inlet valve. According to another embodiment, the initial low duty cycle stroke is omitted in this second method of control. At the instance 404, the high duty cycle pulse begins. The current through the coil 15, 204 takes some finite time to increase due to the inductance of the coil, reaching its maximum level at instance 405. After instance 404, the speed of the coil 15, 204 increases substantially, which is responsible for the reduction in the voltage after instance 405. An increase in coil speed leads to a reduction in the current through the coil 15, 204 and subsequently a reduction in the voltage across the current sense resistor 207 due to the back EMF generated by the moving coil.

For the waveform 402, at instance 406 the voltage increases sharply because the piston 17 has sufficient speed to generate sufficient pressure inside the fluid pumping chamber 40 to close the inlet valve, which further increases the pressure and decelerates the piston 17 and coil 15 velocity. The closing of the inlet valve marks the beginning of the high pressure portion of the stroke. At some time after the high pressure portion of the stroke begins, the velocity of the coil 15 slows down to some steady value greater than zero, which can be observed by the voltage level 410. According to the exemplary embodiment shown, at the instance 411, the end face 39 of the piston 17 impacts the top face 101 of the outlet valve retainer 102, causing oscillations 412 in the waveform 402. After the oscillations 412, the piston 17 comes to a rest, which can be seen in the shift of the voltage from voltage level 410 to voltage level 409. At the instance 413, the high duty cycle pulse stops and the voltage rapidly falls to zero.

For the waveform 401, since there is no liquid fuel inside the fluid pumping chamber 40, fuel vapor or air in the fluid pumping chamber 40 does not generate significant pressure when it is pushed (e.g., squeezed, forced, etc.) out of the fluid pumping chamber 40 through the inlet valve. Accordingly, the inlet valve does not close. Instead, according to the embodiment shown, the current in waveform 401 increases sharply at the instance 407 when the end face 39 of the piston 17 contacts the top face 101 of the outlet valve retainer 102 and rebounds (e.g., bounces), which can be seen in the oscillations 408. As shown, the high duty cycle pulse is still being applied after the oscillations prior to instance 411, thereby causing the piston 17 to remain in contact with (e.g., rest against, press against, push against, etc.) the outlet valve retainer 102 and causing the voltage of the corresponding waveform 401 to be at the voltage level 409. At the instance 413, the high duty cycle pulse stops and the voltage rapidly falls the zero.

As described with respect to the waveform 401, the processing electronics may be configured to determine when liquid is not being pumped. Accordingly, the processing electronics may be configured to run the injector for a predetermined number of cycles or a predetermined amount of time in an attempt to prime the injector. As described above, residual fuel fluid in the fluid pumping chamber 40 reduces the impact of the piston 17 on the outlet valve. Accordingly, the processing electronics may be configured to cease operation of the injector after the predetermined number of cycles or predetermined amount of time. The predetermined number of cycles or predetermined amount of time may correlate to the cycles or time necessary to pump fluid from a tank to the injector. An injector priming module in the processing electronics may be configured to control the injector 10 as described above.

For both the 401 and 402 waveforms, the voltage level 409 is equal to the supply voltage multiplied by the ratio of the resistance of the current sense resistor 207 over the sum of the resistance of the current sense resistor 207, the resistance of the transistor 202, and the resistance of the coil 204. During operation of the injector 10, the temperature of the coil 15, 204, the current sense resistor 207, and the transistor 202 rises, thereby changing the resistances thereof. Specifically, the resistance of the coil 15, 204 rises; thus, for a given current through the coil 15, 204, the voltage across the coil 15, 204 increases, and for a given voltage across the coil 15, 204, the current through the coil 15, 204 decreases. Accordingly, the processing electronics may control the voltage across, or current through, the coil 15, 204 in response to the temperature of the coil 15. For example, the processing electronics may control the voltage across the coil 15, 204, for example, at node 201, in response to the voltage level 409. According to one embodiment, a self-calibration module in the processing electronics may be configured to determine, provide, and/or store updated current or voltages values in response to the temperature change in the coil 15. The processing electronics may further be configured to stop current to the coil 15 when a voltage at voltage level 409 is sensed, thereby reducing cycle times and possibly reducing wear on the components. The processing electronics may further be configured to calculate the time between instance 312 and instance 313, which is the time required for the main spring 18 to accelerate the moving components until the cage 16 makes contact with the plate 13. This time may be used to calculate the piston stroke length of the previous stroke, or may be used to indicate abnormal operation. For example, if the fluid pumping chamber or injector is not substantially full of fuel, the drag and pressure forces on the moving components will be reduced, and the time between instance 312 and instance 313 will be reduced.

For both 401 and 402 waveforms, the total length of the high pressure portion of the stroke can be determined by the time between when the voltage first increases rapidly to when it reaches the voltage level 409. For example, for waveform 401, the time is nearly zero, and for waveform 402, the time is between the instance 406 and instance 411. In an alternative method of control, the voltage applied across the coil can be stopped before the piston is stopped by the outlet valve retainer in which case the length of the high pressure portion of the stroke can be determined by the time between when the voltage first increases rapidly to when the current is stopped. This method of control is pressure driven rather than of the positive displacement type. In this method of control, the initial low duty cycle pulse is not required for metering.

The system and method described with respect to the waveform of FIG. 12 is advantageous for control because it is able to sense the velocity of the coil without stopping the current through the coil, which allows processing electronics with a high sampling rate to be used. Thus, the processing electronics is able to determine with great precision when the inlet valve closes and the high pressure portion of the stroke begins, when the end face of the piston impacts the top face of the outlet valve retainer, and if these events happen. Using this information, the processing electronics can potentially self-calibrate itself to spray the correct amount of fuel despite variations in the manufacturing of the fuel injector and in the circuit components. For example, a self-calibration module in the processing electronics may be configured to determine, provide, and/or store updated values. Furthermore, the processing electronics can determine when there is no fuel inside the fluid pumping chamber such as during hot soak conditions and activate a series of rapid strokes to prime the pump. A high pressure portion of the stroke module in the processing electronics may be configured to control of the injector 10 as described above with respect to FIG. 12.

Furthermore, as described above with respect to FIG. 12, the process electronics may be able to sense the closing of the inlet valve. According to some embodiments, the inlet valve can only close when the fluid pumping chamber is nearly completely full of fuel. Thus, control of the initial low pressure portion of the stroke, as described with respect to FIG. 11, may not be necessary. According to other embodiments, the systems and methods for FIG. 12 may be used by the processing electronics to determine when to begin the long pulse width corresponding to the high pressure portion of the stroke (e.g., instance 310 as shown in FIG. 11).

The control and sensing methods described with regards to the waveforms of FIG. 11 and FIG. 12 may be used separately or in conjunction. In one method, the length of the initial low pressure portion of the stroke is varied as described with respect to FIG. 11. In a second method of control, the length of the initial low pressure portion of the stroke is fixed or not controlled while the length of the second high duty cycle stroke is controlled as described with respect to FIG. 12. For example, the length of the second high duty cycle stroke can be controlled by varying the corresponding pulse width. After the current to the coil is stopped, the pressure inside the fluid pumping chamber 40 drops below the cracking pressure of the outlet valve almost immediately. A small amount of fuel may still be injected after the current in the coil is stopped due to the inertia of the moving components.

The construction and arrangement of the elements of the fuel injection system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents, but also equivalent structures. Other substitutions, modifications, changes and omissions may be made in the design, operating configuration, and arrangement of the preferred and other exemplary embodiments without departing from the scope of the appended claims.

What is claimed is:

1. A fuel injector assembly, comprising:

a housing;

a piston disposed in the housing;

an electromagnetic actuator coupled to the piston by a cage, the electromagnetic actuator including a magnet and a coil and configured to produce a force sufficient to move the cage and the piston to pressurize fuel upon energizing the coil; and an outlet valve assembly located in the housing and configured to direct pressurized fuel out of the fuel injector assembly, wherein the outlet valve assembly comprises:

a valve seat;

a moveable valve body;

a spring biasing the moveable valve body against the valve seat;

an orifice member located downstream of the valve seat and the moveable valve body, wherein the orifice member includes one or more orifices through which the pressurized fuel can pass to exit the fuel injector assembly; and a member located downstream of the valve seat and the moveable valve body, wherein at least one of the member and the orifice member is configured to receive the spring.

2. The fuel injector assembly of claim 1, wherein the member includes a cup for receiving the spring.

3. The fuel injector assembly of claim 1, wherein the orifice member includes a cup for receiving the spring.

4. The fuel injector assembly of claim 3, wherein the orifice member is a plate.

5. The fuel injector assembly of claim 1, wherein the spring is a helical spring, and wherein the valve body is a spherical ball.

6. The fuel injector assembly of claim 1, further comprising a turbulence generating member located downstream of the valve seat, wherein the turbulence generating member includes one or more openings.

7. The fuel injector assembly of claim 6, wherein the turbulence generating member is a plate.

8. A fuel injector assembly comprising:

a housing;

a piston disposed in the housing;

an electromagnetic actuator coupled to the piston, the electromagnetic actuator including a magnet and a coil and configured to drive the piston to pressurize fuel upon energizing the coil;

an outlet valve assembly located in the housing and configured to direct pressurized fuel out of the fuel injector assembly, wherein the outlet valve assembly comprises:

a valve seat;

a moveable valve body; and a spring biasing the moveable valve body against the valve seat such that the outlet valve assembly is normally closed;

an orifice member located downstream of the valve seat and the moveable valve body, wherein the orifice member includes one or more orifices through which the pressurized fuel can pass; and a turbulence generating member disposed downstream of the valve seat and including one or more openings configured to increase a velocity of the pressurized fuel.

9. The fuel injector assembly of claim 8, further comprising a member for receiving the spring, wherein the member is located downstream of the valve seat and the moveable valve body.

10. The fuel injector assembly of claim 9, wherein the member includes a cup for receiving the spring.

11. The fuel injector assembly of claim 8, wherein the orifice member includes a cup for receiving the spring.

12. The fuel injector assembly of claim 8, wherein the spring is a helical spring, and wherein the valve body is a spherical ball.

13. The fuel injector assembly of claim 8, wherein the orifice member is a plate.

14. A fuel injector assembly comprising:

a housing;

a piston disposed in the housing;

an electromagnetic actuator coupled to the piston, the electromagnetic actuator including a magnet and a coil and configured to drive the piston in response to energizing the coil;

an outlet valve assembly located in the housing and configured to direct pressurized fuel out of the fuel injector assembly, wherein the outlet valve assembly comprises:

a valve seat;

a moveable valve body; and a spring biasing the moveable valve body against the valve seat such that the outlet valve assembly is normally closed;

an orifice plate located downstream of the valve seat and the moveable valve body, wherein the orifice plate includes one or more orifices through which the pressurized fuel can pass; and a turbulence generating plate disposed downstream of the valve seat and including one or more openings configured to increase a velocity of the pressurized fuel.

15. The fuel injector assembly of claim 14, further comprising a member for receiving the spring, wherein the member is located downstream of the valve seat and the moveable valve body.

16. The fuel injector assembly of claim 15, wherein the member includes a cup for receiving the spring.

17. The fuel injector assembly of claim 14, wherein the orifice member includes a cup for receiving the spring.

18. The fuel injector assembly of claim 14, wherein the spring is a helical spring, and wherein the valve body is a spherical ball.

* * * * *